US011293219B2

(12) United States Patent
Zhang

(10) Patent No.: US 11,293,219 B2
(45) Date of Patent: Apr. 5, 2022

(54) SELF-LOCKING BALANCE WEIGHT-TYPE INSULATED GLASS ASSEMBLY WITH INTERNAL BLINDS

(71) Applicant: Xuezhong Zhang, Dalian (CN)

(72) Inventor: Xuezhong Zhang, Dalian (CN)

( * ) Notice: Subject to any disclaimer, the term of this patent is extended or adjusted under 35 U.S.C. 154(b) by 305 days.

(21) Appl. No.: 16/542,478

(22) Filed: Aug. 16, 2019

(65) Prior Publication Data

US 2021/0040793 A1 Feb. 11, 2021

(51) Int. Cl.
*E06B 9/264* (2006.01)
*E06B 9/322* (2006.01)

(52) U.S. Cl.
CPC ..... *E06B 9/264* (2013.01); *E06B 9/322* (2013.01); *E06B 2009/2646* (2013.01)

(58) Field of Classification Search
CPC .... E06B 9/32; E06B 9/322; E06B 2009/3222; E06B 9/303; E06B 9/262; E06B 9/38; E06B 2009/2625; E06B 2009/2627; E06B 9/264; E06B 2009/2643; E06B 2009/2646
See application file for complete search history.

(56) References Cited

U.S. PATENT DOCUMENTS 5,205,070 A * 4/1993 Lundstrom ..... E05D 13/145 49/200
7,475,715 B2 * 1/2009 Gardner ..... E06B 9/264 160/107
7,669,633 B2 * 3/2010 Berger ..... E06B 3/04 160/107
7,896,056 B2 * 3/2011 Ben-David ..... E06B 9/264 160/107
8,499,815 B2 * 8/2013 Zhang ..... E06B 9/32 160/176.1 R
2003/0075285 A1 * 4/2003 Anderson ..... E06B 9/264 160/90
2008/0029226 A1 * 2/2008 Huang ..... E06B 9/264 160/107
2009/0071610 A1 * 3/2009 Bossler ..... E06B 9/326 160/38
2012/0285634 A1 * 11/2012 Zhu ..... E06B 9/56 160/340

(Continued)

*Primary Examiner* — Jerry E Redman
*Assistant Examiner* — Abe Massad
(74) *Attorney, Agent, or Firm* — Daniel M. Cohn; Howard M. Cohn

(57) ABSTRACT

An insulated glass assembly has internal blinds that are magnetically operated, balanced and can be locked in in place and a front and rear pane of glass having an internal blind assembly therebetween. The internal blind assembly includes first and second pull cords mounted to an upper end of an internal magnetic operator disposed within a side rail which directs the pull cords upward to a fixed connector. The internal magnetic operator is connected to a chain of weights which provide a counterweight for the internal blinds. The internal magnetic operator further has a first plurality of magnets which are disposed in a magnet receiving cavity extending through the internal magnetic operator. A back plate is disposed against the plurality of magnets in the internal magnetic operator. A spring exerting a bias force on the backplate to normally press the backplate away from a rear surface of the internal magnetic operator such that the spring engages the side rail and locks the internal magnetic operator in place.

19 Claims, 5 Drawing Sheets

(56) References Cited

U.S. PATENT DOCUMENTS

| | | | | |
|---|---|---|---|---|
| 2014/0209256 | A1* | 7/2014 | Zhang | E06B 9/264 160/107 |
| 2015/0300081 | A1* | 10/2015 | Zhang | E06B 9/384 160/107 |
| 2017/0009520 | A1* | 1/2017 | Zheng | E06B 9/264 |
| 2021/0131174 | A1* | 5/2021 | Zhang | E06B 9/264 |

* cited by examiner

SELF-LOCKING BALANCE WEIGHT-TYPE INSULATED GLASS ASSEMBLY WITH INTERNAL BLINDS

FIELD OF THE INVENTION

The present invention relates to blinds assemblies, and in particular, to a self-locking, balance weight-type insulated glass assembly with internal blinds.

BACKGROUND OF THE INVENTION

Insulated glass assemblies with internal blinds have the advantages of heat insulation and sound insulation of the insulated glass as well as the functions of shielding against sunlight and obstructing the view of the blind assemblies. Insulated glass assemblies with internal blinds needs no dusting on the blinds itself. The insulated glass assemblies with internal blinds afford the unique advantages of long service life and are therefore being used more and more widely and are becoming larger and larger in sizes. In order to ensure the airtightness of the insulated glass assemblies with the internal blinds, the internal blinds are, in most cases, magnetically controlled. However, magnetic control of large-sized blinds assemblies will become very difficult due to the large weight of the slats and the large friction created between the slats and glass.

One way to obviate this situation is to configure a counterweight on an internal magnetic operator to reduce control force demanded. However, due to the fact that the control force required for lifting the blinds assembly increases gradually while the weight of the counterweight is constant, only part of the weight of blind's slats is balanced. When the insulated glass assembly with internal blinds is assembled and transported, the unfixed counter-weight can move randomly and destroy parts located nearby to the counterweight.

BRIEF SUMMARY OF THE INVENTION

According to an embodiment of the present invention, there is an insulated glass assembly with internal blinds that are magnetically operated, balanced and can be locked in place. A front and rear pane of glass and an internal blinds assembly are disposed therebetween. The internal blinds assembly includes the first and second pull cords mounted to an upper end of an internal magnetic operator disposed within a side rail which directs the pull cords upward to a fixed connector. The internal magnetic operator is connected to a chain of weights which provide a counterweight for the internal blinds. The internal magnetic operator further has a first plurality of magnets which are disposed in a magnet receiving cavity extending through the internal magnetic operator. A back plate is disposed against the plurality of magnets in the internal magnetic operator. A spring exerting a bias force on the end tips of backplate to normally press the backplate away from a rear surface of the internal magnetic operator such that the spring engages the side rail and locks the internal magnetic operator in place.

According to yet another embodiment of the invention, there is provided an insulated glass assembly with internal blinds that are magnetically operated, balanced and can be locked in place. Front and rear panes of glass have an internal blind assembly therebetween. The internal blind assembly includes first and second pull cords mounted to an upper end of an internal magnetic operator disposed within a side rail which directs the pull cords upward to a fixed connector. The internal magnetic operator is connected to a chain of weights, constructed of a plurality of weights, which provide a counterweight for the internal blinds. The internal magnetic operator further has a first plurality of magnets constructed with a magnet receiving cavity extending through the internal magnetic operator body. A back plate is disposed against the plurality of magnets in the internal magnetic operator. A V-shaped flat spring mounted in the internal magnetic operator exerts a bias force on the backplate to normally press the backplate away from a rear surface of the internal magnetic operator such that the spring engages the side rail and locks the internal magnetic operator in place.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader and should not in any way be interpreted as limiting.

DETAILED DESCRIPTION OF THE INVENTION

Figure 1:
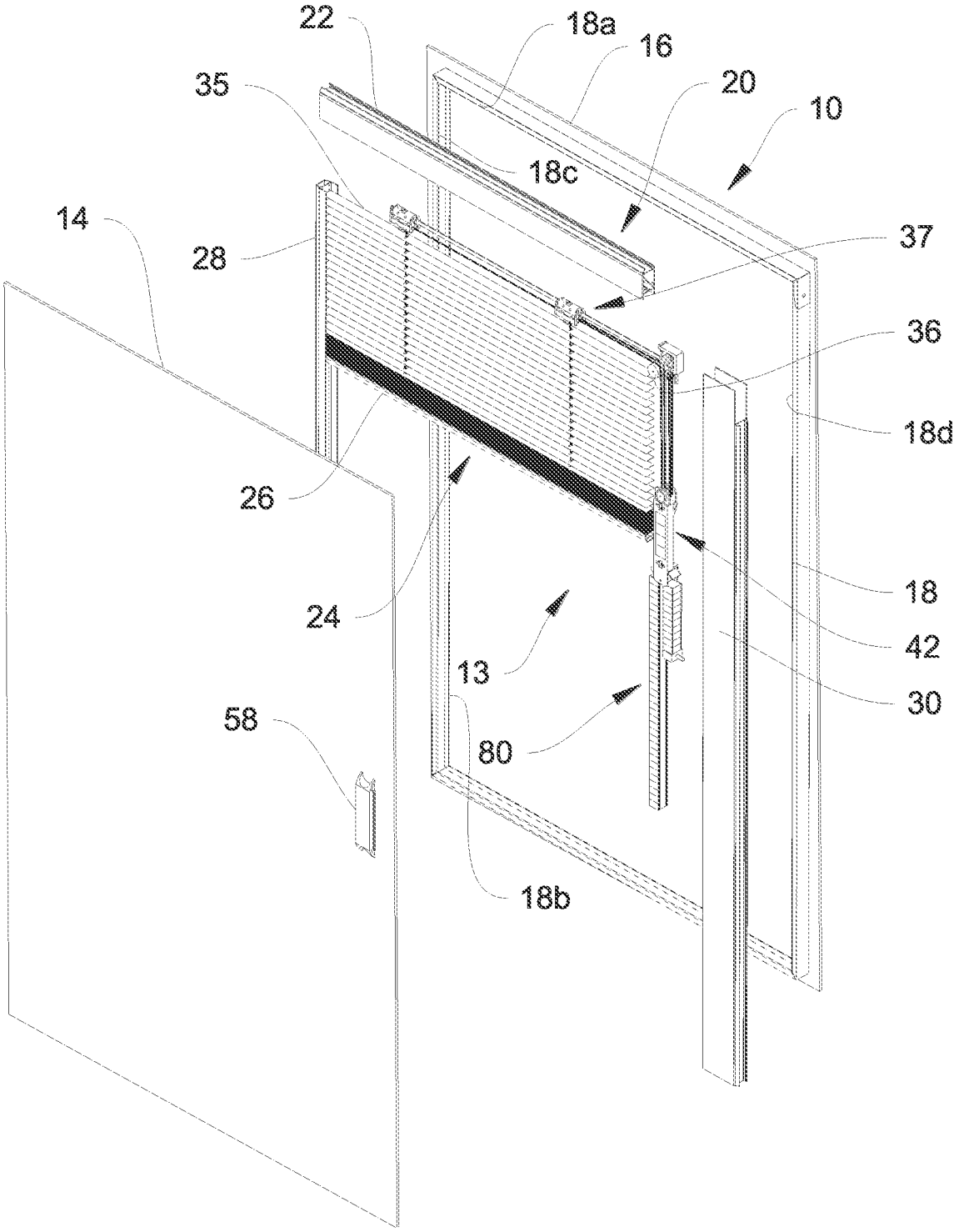
FIG. 1 is a three-dimensional exploded view of an insulated glass assembly with internal blinds that are magnetically operated and balanced, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader and should not in any way be interpreted as limiting.

Referring to FIG. 1, there is illustrated a three-dimensional, exploded view of the insulated glass assembly with internal blinds 10 that are magnetically operated, balanced and can be locked in place, in accordance with the present invention. The self-locking, balance weight-type insulated glass assembly with internal blinds 10 comprises two sheets or panes 14 and 16 of glass, a rectangular spacer frame 18, and an internal blind assembly 13. The two sheets 14 and 16 of front and rear glass, respectively, are arrayed front and back, respectively, and disposed against opposite sides of a rectangular shaped spacer frame 18 to form an insulated inner cavity 20. A sealant can be disposed about the joint formed between the front sheet of glass 14 and an inner peripheral surface 18*a* of the spacer frame 18 and about the joint formed between the rear sheet of glass 16 and an outer peripheral surface 18*b* of the spacer frame 18.

Figure 2:
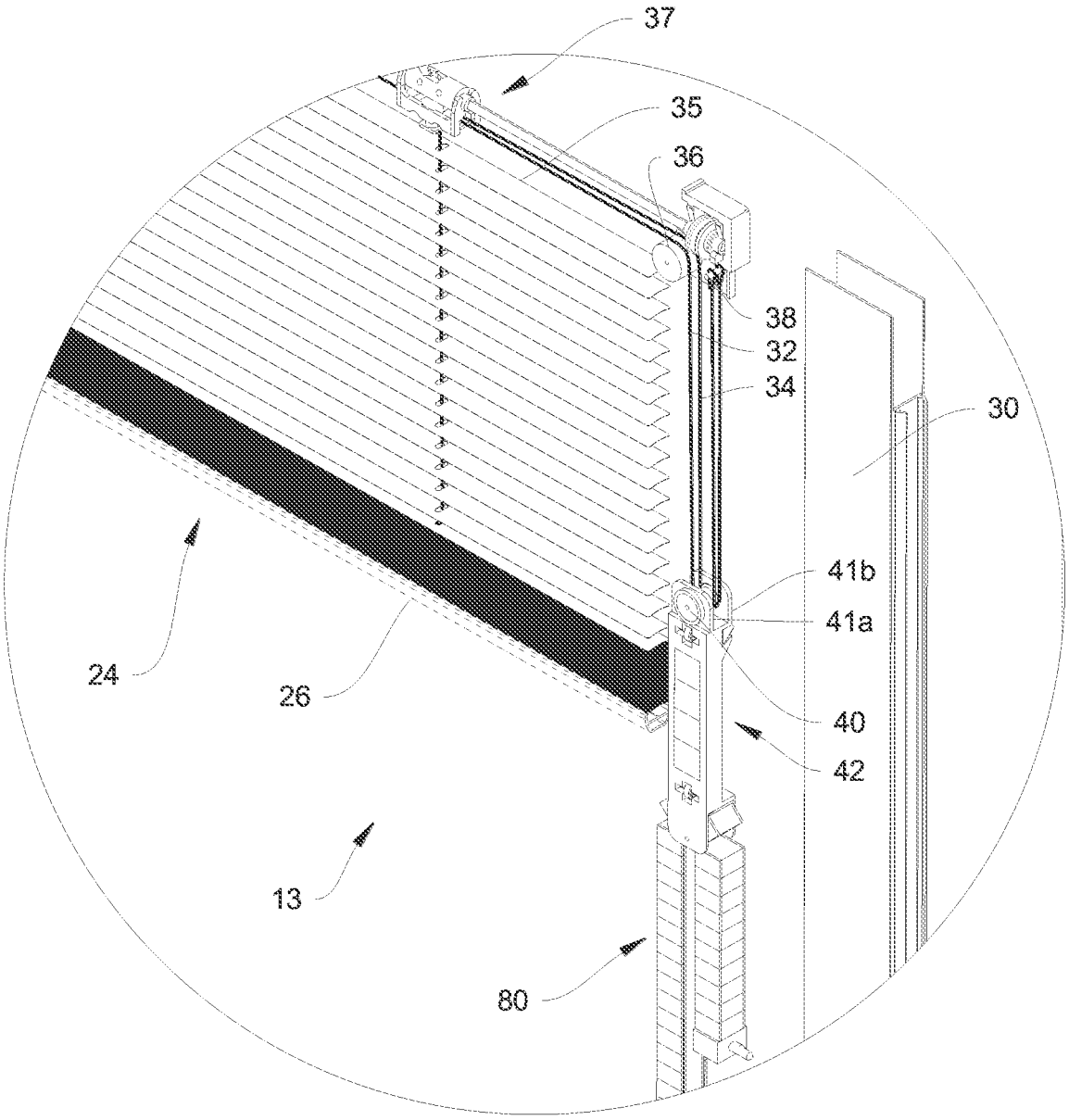
FIG. 2 is a partial three-dimensional, exploded view of the internal blinds for an insulated glass assembly with internal blinds, in accordance with the present invention.

The internal blinds assembly 13 includes a head rail 22 attached to the underside of the spacer frame 18, a slat assembly 24 hung on the head rail 22, a privacy fascia 28 and a side rail 30. The slat assembly 24 includes at least two cords 32 and 34, a group of slats 35 with holes letting the two cords 32 and 34 go through, and a bottom rail 26 to which one end of each cord 32 and 34 is attached. The privacy fascia 28 and the side rail 30 are attached to opposite sides 18*c* and 18*d* of the spacer frame 18, respectively. The head rail 22 has a generally u-shaped cross-section, and the two pull cords 32 and 34 are threaded through the slats 35 and are attached at one end to the bottom rail 26. The opposite ends of the two cords 32 and 34 pass rightward through the tilting barrel assembly 37 disposed inside the head rail 22 and then over a roller support 36. The roller support 36, which is disposed inside the headrail 22 close to the right end, guides the pull cords 32 and 34 downward to a rotary cylinder 40 which is mounted between the upper spaced ends 41*a* and 41*b* of an internal magnetic operator body 41. The rotary cylinder 40 directs the opposite ends of pull cords 32 and 34 upward to a fixed connector 38, as shown in FIG. 2, to which both of the pull cords are attached. The connector 38 is fixed in the headrail 22.

The internal magnetic operator 42 disposed inside the side rail 30, has a plurality of magnets 46, including 46*a*, 46*b*, 46*c* and 46*d* (46*a*-46*d*), which are stacked upon each other and inserted through a front opening 50 of a magnet receiving cavity 52. While the magnets 46*a*-46*d* are shown having a rectangular shape, it's within the terms of the present invention to form the magnets with any desired shape. The cavity 52 extends to a rear opening 54 which opens to a backplate receiving cavity 55 that extends to the rear surface of the internal magnetic operator body 41. The backplate receiving cavity 55 is closed by a backplate 66. The magnet receiving cavity 52 has a lip 56 extending thereabout which serves to prevent the magnets 46*a*-46*d* from passing out of the magnet receiving cavity 52 through the backplate receiving cavity 55.

Figure 4:
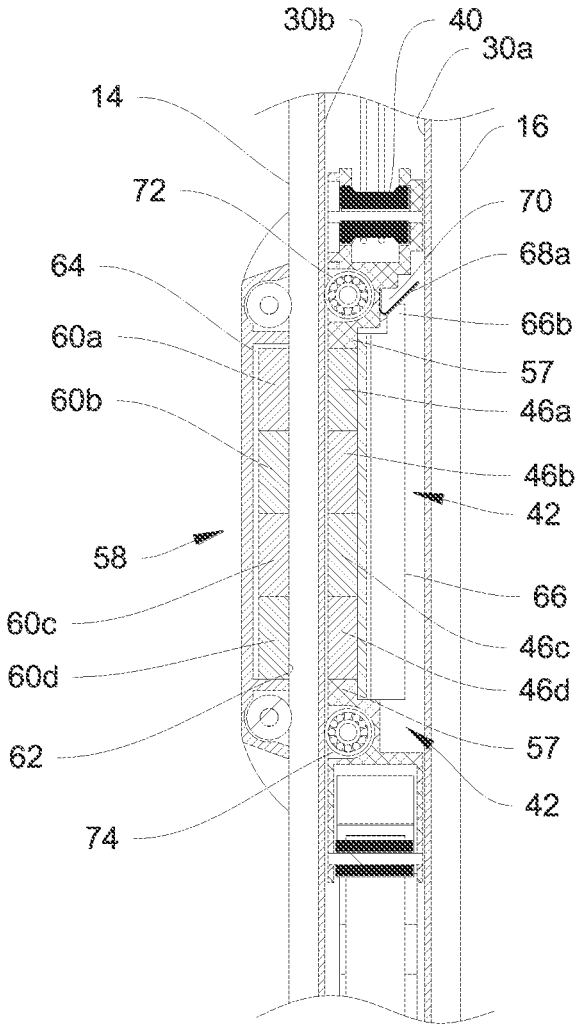
FIG. 4 is a cross-sectional view showing the locking mechanism in a first condition, in accordance with the present invention.

The external magnetic operator 58, as shown in FIG. 4, has a plurality of magnets 60, including 60*a*, 60*b*, 60*c* and 60*d* (60*a*-60*d*), which are stacked upon each other and inserted through an opening 62 of a magnet receiving cavity 64 extending into the magnetic operator 58. The external magnetic operator 58 is magnetically coupled to the internal magnetic operator 42 and is arranged outside the insulated glass panel 14 as shown in FIG. 4. As further shown in FIG. 1, the external magnetic operator 58 is disposed on the outside surface of the front sheet 14 of glass and being magnetically coupled to the internal magnetic operator 42, is able to move the internal magnetic operator 42 when the external magnetic operator 58 is moved.

Figure 3:
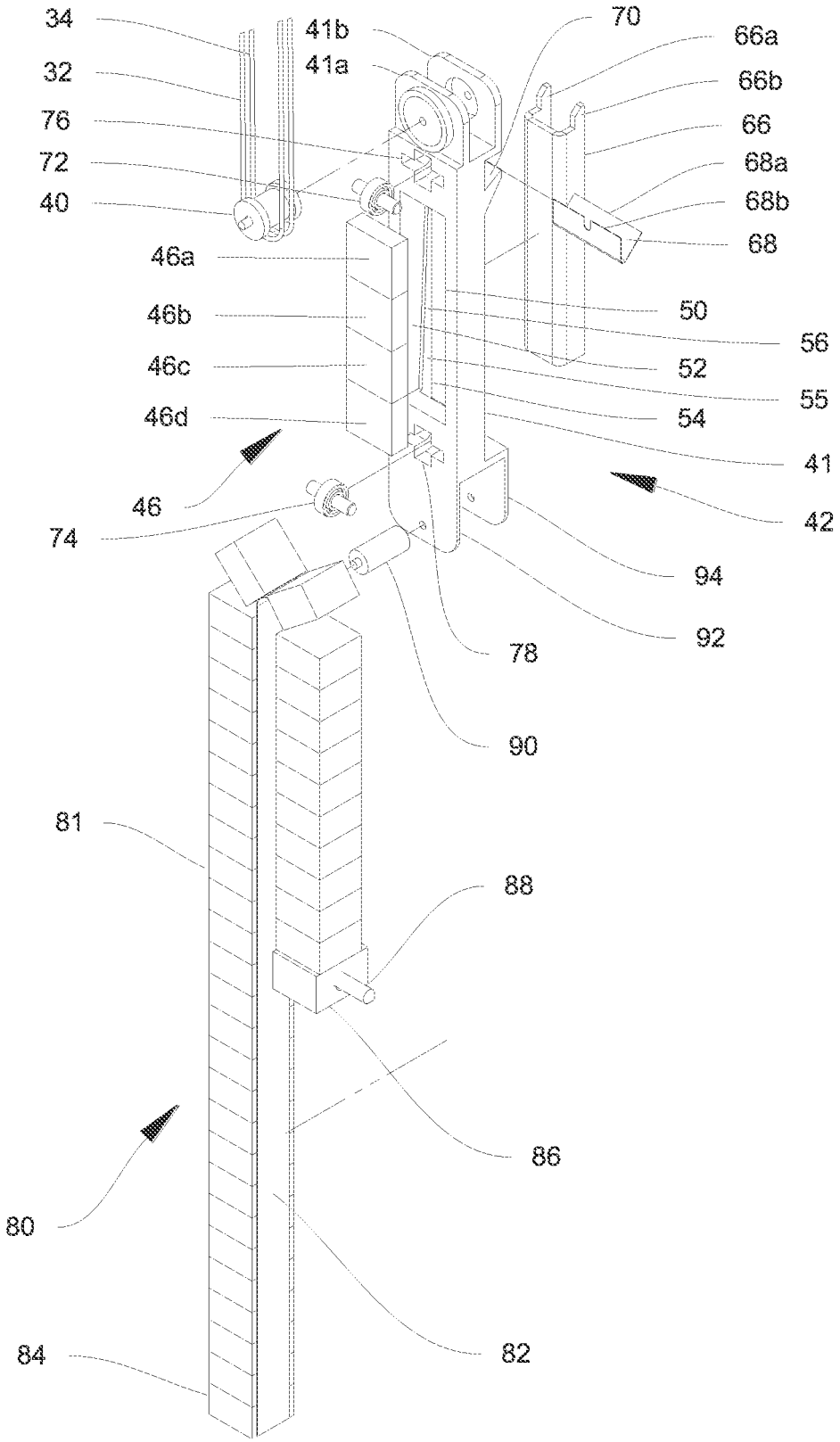
FIG. 3 is a three-dimensional, exploded view of the internal magnetic operator and the chain of weights, in accordance with the present invention.
Figure 5:
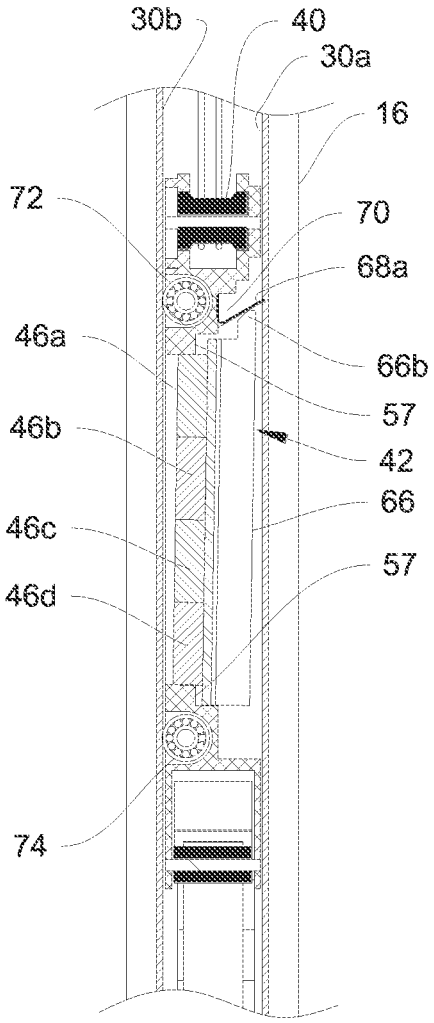
FIG. 5 is a cross-sectional view showing the locking mechanism in a second condition, in accordance with the present invention.
Figure 6:
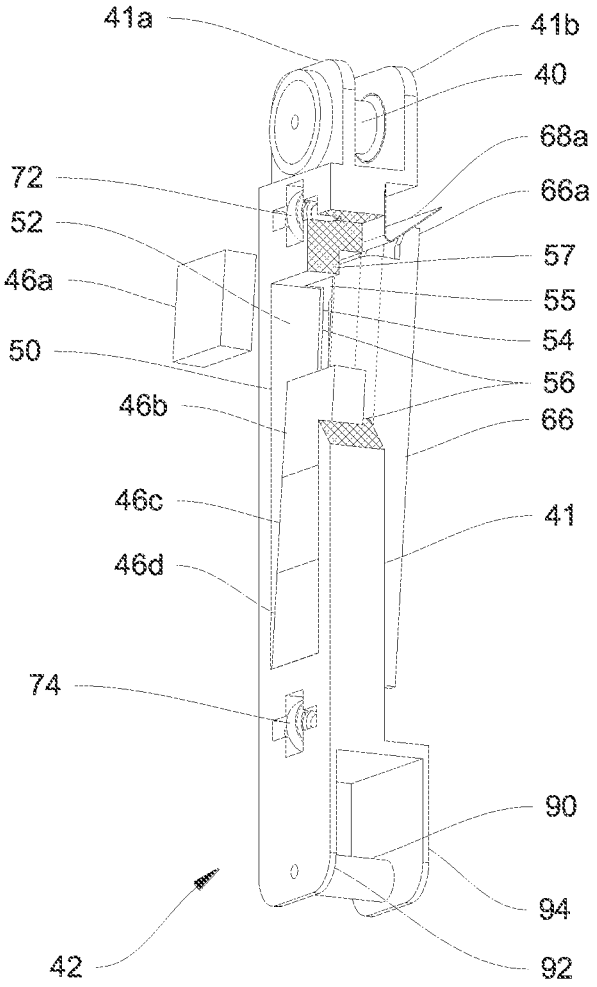
FIG. 6 is a three-dimensional partial cross-sectional view showing the locking mechanism of an internal magnetic operator in a second condition, in accordance with the present invention.
Figure 7:
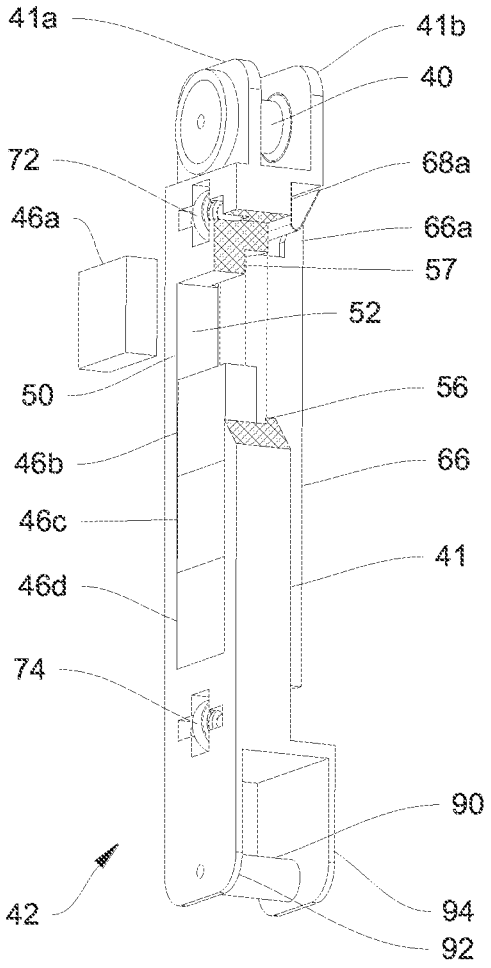
FIG. 7 is a three-dimensional partial cross-sectional view showing the locking mechanism of the internal magnetic operator in a first condition, in accordance with the present invention.

A back plate 66 is disposed in the backplate receiving cavity 55 and is attracted against the magnets 46*a*-46*d* as best seen in FIGS. 3, 4, and 5. The back plate 66 is part of the mechanism that releases the internal magnetic operator 42 from locking in place when transporting the assembled glass assembly 10. The backplate receiving cavity 55 has a shoulder 57, as best seen in FIGS. 4 and 5, against which the backplate 66 rests when the external magnetic operator 58 is disposed on the outside the insulated glass panel 14 at a location where it is magnetically coupled to the internal magnetic operator 42. When the backplate 66 is pressed against the shoulder 57 in response to the magnets 60*a*-60*d* pulling the magnets 46*a*-46*d* towards the inner surface 30*b* of the side rail 30, the backplate which is magnetically coupled to the magnets 46*a*-46*d*, is pulled against the shoulder 57.

A V-shaped, flat spring 68 is disposed in a slot 70 in the internal magnetic operator body 41. As shown in FIG. 4, the V-shaped flat spring 68 engages end tips 66*a* and 66*b* of the backplate 66 and is prevented from engaging the inner surface 30*a* of the side rail 30. When the external magnetic operator 58 is magnetically uncoupled from the internal magnetic operator 42, the backplate 66 moves out of contact with the shoulder 57 in response to the V-shaped flat spring 68 being biased outward to engage the inner surface 30*a* of the side rail 30 and to lock the magnetic operator 42 in place when transporting the assembled glass assembly, as discussed in more detail hereinafter. When the spring 68 is biased outward as shown in FIG. 5, the backplate 66 with the magnets magnetically coupled thereto is pressed by the spring towards the inner surface 30*a* of the side rail 30.

Two bearings 72 and 74 are disposed in slots 76 and 78, respectively, and are pressed against the inner surface 30*b* of the side rail 30 so that the magnetic operator 42 is able to easily and freely move up and down within the side rail when it is not locked in place by the spring 68.

Referring again to FIG. 3, a chain of weights 80, which provide a counterweight for the slat assembly 24, is constructed of a plurality of weights 81 secured to a flexible sheet 82 of material such as, for example, a fabric or thin sheet of steel. The weights 81 can be formed of different shapes, such as for example a rectangular prism, and disposed with the face of one weight in contact with the adjacent weight so that the chain of weights extending upward to the roller 90 are held in a single line and don't twist or bend. However, as shown in FIG. 3, when the section of the chain 80 crosses the roller 90, the faces of the weights crossing the roller move away from an adjacent weight.

It is within the terms of the present invention to construct the weights of hollow prisms and to insert weights of a different mass in the hollow part of the prism, depending on the amount of counterweight required.

One end 84 of the chain of weights 80 is free and the other end 86 is fixed by a screw 88 to the side rail 30. The chain of weights 80 is disposed over a roller 90 mounted within spaced end sections 92 and 94 of the internal magnetic operator body 41 so that the free end 84 of the chain of weights 80 can move up and down within the side rail 30.

The internal magnetic operator 42 and the chain 80 are disposed in the side rail 30. The end 86 of the chain 80 is secured to the side rail 30 by the screw 88.

When the slat assembly 24 is pulled up towards a fully folded state as shown in FIG. 1, the free end 84 of the chain of weights 80 which provides a counterweight to the slat assembly 24, moves towards a position that is its lowest or furthest distance from the head rail 22 and the internal magnetic operator 42 moves towards its lowest location with respect to the head rail 22. At this stage of the operation, the length of the chain of weights 80 from the roller 90 to the free end 84 of the chain of weights 80 is at a maximum and therefore the weight of the chain of weights 80 hanging from the roller 90 is near the maximum so that it can balance the weight of the slat assembly 24 lifted by cords 32 and 34. Then, as the internal magnetic operator 42 is raised so that the slat assembly 24 is lowered, the length of the chain of weights 80 from the roller 90 to the free end 84 is shortened while the length of chain of weights 80 from the fixed end 86 to the roller 90 increases. With continued movement of the internal magnetic operator 42 upward, the length of the chain of weights 80 from the roller 90 to the free end 84 becomes less and less, balancing less and less weight of the slat assembly 24 lifted by cords 32 and 34.

An important aspect of the present invention is that after the insulated glass assembly with internal blinds 10 is fully assembled and moved, there is a reasonable possibility that the chain of weights 80 and the internal magnetic operator 42 can move about and possibly break or get out of alignment. Furthermore, the random movement of the chain of weights 80 and the internal magnetic operator 42 will release the tension of the pull cords 32 and 34 so that the slats 35 are not held in a fully folded state and thereby allowing them to easily get bent due to vibration of transporting. Since the insulated glass assembly with internal blinds 10 are sealed, often with a waterproof filler and sealant to form the insulted barrier, it would be very difficult and time consuming to take the insulated glass assembly apart and reset the chain of weights 80 and the internal magnetic operator 42 into place. The chain of weights 80 and the internal magnetic operator 42 are designed to overcome this problem.

After the insulated glass assembly with internal blinds 10 is fully assembled and the slats assembly 24 is pulled up in a fully folded state, external magnetic operator 58 is moved to a location where the magnetic fields from the magnets 60*a*-60*d* are not magnetically coupled with the magnets 46*a*-46*d* of the internal magnetic operator 42, as shown in FIG. 5. The magnetic force of the magnets 46*a*-46*c* causes the magnets to engage against the back surface of the back plate 66.

In this condition, a V-shaped flat spring 68 is released from pressing inward by end tips 66*a* and 66*b* of the backplate 66 due to the removal of the attracting force from external magnetic operator 58. The V-shaped flat spring 68, as shown in FIG. 3, is disposed in a slot 70 formed in an upper portion of the internal magnetic operator body 41. One edge 68*a* of the spring 68 is biased outward so that it presses the end tips 66*a* and 66*b* of the backplate 66 outward from the backplate receiving cavity 55 of the internal magnetic operator body 41 and against or nearly against the inner surface of the rear side 30*a* of the side rail 30. At this time, the magnets 46*a*-46*d* are pulled away from the pane of glass 14.

Concurrently, as shown in FIG. 5, the outer edge 68*a* of the V-shaped flat spring 68 engages the inner wall 30*a* of the side rail 30. The contact of the outer edge 68*a* of the spring 68 against the plastic inner surface 30*a* of the side rail 30 prevents the movement of the internal magnetic operator 42 toward headrail 22 so that the slats assembly 24 is held in a fully folded state.

When the external magnetic operator 58 is moved back to a location, as shown in FIG. 4, the magnetic forces of magnets 60*a*-60*b* pull the magnets 46*a*-46*d* together with backplate 66 towards the pane of glass 14 until the back plate returns to being in contact with shoulder 57. In this condition, the outer edge 68*a* of the V-shaped flat spring 68 is pressed inward by the end tips 66*a* and 66*b* of the back plate 66 in response to the magnetic force and disengages from the inner wall 30*a* of the side rail 30 so that the internal magnetic operator 42 can move the slats assembly 24 to open and close the blinds.

When the movement of the internal magnetic operator 42 is prevented, as shown in FIG. 5 and discussed herein before, the chain of weights 80 are also prevented from moving because the screw 88 attached to the fixed end 86 of the chain of weights 80 is affixed to the side rail 30. In addition, each of the weights 81 engages the surface of an adjoining weight and are therefore are only able to bend in a first direction so that they can pass over the roller 90. Further, when the weights 81 are disposed one on another, the chain of weights 80 is straight and can only bend in the first direction. Also, the chain of weights 80 is disposed within the side rail 30 and the side walls 30*a* and 30*b* of the side rail 30 prevent the line of weights from bending in a direction other than the first direction.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. An insulated glass assembly with an internal blind assembly that is magnetically operated, balanced and can be locked in place, comprising:

a front and rear pane of glass, a spacer frame and the internal blind assembly therebetween;

the internal blind assembly including first and second pull cords mounted to an upper end of an internal magnetic operator disposed within a side rail which directs the first and second pull cords upward to a fixed connector;

the internal magnetic operator further having a first plurality of magnets which are disposed in a magnet receiving cavity extending through the internal magnetic operator;

a back plate disposed against the first plurality of magnets in the internal magnetic operator; and a spring exerting a bias force on the back plate and configured to press the back plate away from a rear surface of the internal magnetic operator such that the spring engages the side rail and locks the internal magnetic operator in place.

2. The insulated glass assembly of claim 1 further including the first plurality of magnets disposed in the magnet receiving cavity extending through the internal magnetic operator body and wherein the first plurality of magnets are stacked upon each other.

3. The insulated glass assembly of claim 2 wherein a rear opening of the magnet receiving cavity has a lip extending thereabout which serves to prevent the first plurality of magnets from passing out of the magnet receiving cavity through the rear opening.

4. The insulated glass assembly of claim 3 wherein the spring is a V-shaped flat spring mounted in the internal magnetic operator with a first leg engaging the back plate to bias the back plate away from the rear surface of the internal magnetic operator.

5. The insulated glass assembly of claim 4 further including a chain of weights secured to each other and disposed over a roller mounted at one end of the internal magnetic operator to provide a counterweight for the internal blind assembly.

6. The insulated glass assembly of claim 5 wherein the chain of weights includes a plurality of weights disposed with each of the weights in contact with an adjacent weight so that the chain of weights extends upward to the roller from a fixed end and is held in a single line so as not to bend or twist.

7. The insulated glass assembly of claim 6 wherein when a section of the chain of weights crosses the roller, the weights in that section move away from an adjacent weight.

8. The insulated glass assembly of claim 7 wherein the plurality of weights are constructed of hollow prisms which can receive weights of a different mass therein.

9. The insulated glass assembly of claim 8 wherein a first end of the chain of weights is free and a second end of the chain of weights is fixed by a screw to the side rail.

10. The insulated glass assembly of claim 9 wherein the chain of weights is disposed over the roller mounted to the internal magnetic operator so that the first end of the chain of weights can move up and down within the side rail.

11. The insulated glass assembly of claim 1 wherein an external magnetic operator is arranged on one side of the front pane of glass and is magnetically coupled to the internal magnetic operator disposed between the front and rear panes of glass.

12. The insulated glass assembly of claim 11 wherein the insulated glass assembly has:

a first condition when the first plurality of magnets in the internal magnetic operator are magnetically coupled to the external magnetic operator whereby the internal magnetic operator is free to move within the side rail; and a second condition wherein the first plurality of magnets in the internal magnetic operator are magnetically uncoupled from the external magnetic operator and the internal magnetic operator is held in place.

13. An insulated glass assembly with an internal blind assembly that is magnetically operated, balanced and can be locked in place, comprising:

a front and rear pane of glass, wherein the internal blind assembly is positioned between the front and rear pane of glass;

the internal blind assembly including first and second pull cords mounted to an upper end of an internal magnetic operator disposed within a side rail which directs the pull cords upward to a fixed connector;

the internal magnetic operator connected to a chain of weights, constructed of a plurality of weights which provide a counterweight for the internal blind assembly;

the internal magnetic operator further having a first plurality of magnets which are disposed in a magnet receiving cavity extending through the internal magnetic operator;

a back plate disposed against the first plurality of magnets in the internal magnetic operator; and a V-shaped spring mounted to the internal magnetic operator exerting a bias on the back plate and configured to press the back plate away from a rear surface of the internal magnetic operator such that the spring engages the side rail and locks the internal magnetic operator in place.

14. The insulated glass assembly of claim 13 wherein the plurality of weights are disposed with one of the plurality of weights in contact with an adjacent one of the plurality of weights so that the chain of weights extends from a second end upward to a roller mounted to the internal magnetic operator and is held in a single line and doesn't bend or twist.

15. The insulated glass assembly of claim 14 wherein an external magnetic operator disposed on the outside of the front pane of glass is magnetically coupled to the internal magnetic operator and can move the internal magnetic operator when the external magnetic operator is moved.

16. The insulated glass assembly of claim 15 wherein when a section of the chain of weights crosses the roller, a face of one of the plurality of weights in the section moves away from an adjacent one of the plurality of weights.

17. The insulated glass assembly of claim 16 wherein the chain of weights is disposed over the roller so that a first end of the chain of weights can move up and down within the side rail.

18. The insulated glass assembly of claim 17 wherein the first end of the chain of weights is free and the second end of the chain of weights is fixed by a screw to the side rail.

19. The insulated glass assembly of claim 15 wherein the insulated glass assembly has:

a first condition when the first plurality of magnets in the internal magnetic operator are magnetically coupled to the external magnetic operator whereby the internal magnetic operator is free to move within the side rail; and a second condition wherein the first plurality of magnets in the internal magnetic operator are not magnetically coupled to the external magnetic operator and the internal magnetic operator is held in place.

* * * * *